United States Patent [19]

Launder

[11] Patent Number: 4,611,418

[45] Date of Patent: Sep. 16, 1986

[54] LOCKING MECHANISM FOR EARTH EXCAVATION TEETH

[76] Inventor: Richard L. Launder, 8107 San Lucas Dr., Whittier, Calif. 90605

[21] Appl. No.: 716,967

[22] Filed: Mar. 28, 1985

[51] Int. Cl.[4] ..... E02F 9/28

[52] U.S. Cl. ..... 37/141 T; 37/142 A; 172/750; 403/328

[58] Field of Search ..... 37/142 R, 142 A, 141 R, 37/141 T; 172/750; 403/328

[56] References Cited

U.S. PATENT DOCUMENTS

| | | | |
|---|---|---|---|
| 2,538,919 | 1/1951 | Shaff | 37/142 A |
| 2,618,873 | 11/1952 | Hostetter | 37/142 A |
| 2,635,366 | 4/1953 | Hostetter | 37/142 A |
| 2,987,838 | 6/1961 | Stratton | 37/142 A |
| 4,271,615 | 6/1981 | Jones | 37/142 A |

FOREIGN PATENT DOCUMENTS

| | | | |
|---|---|---|---|
| 2514177 | 10/1975 | Fed. Rep. of Germany | 37/142 A |

*Primary Examiner*—Edgar S. Burr

*Assistant Examiner*—Moshe I. Cohen

*Attorney, Agent, or Firm*—Lyon & Lyon

[57] ABSTRACT

A locking mechanism for releasably securing earth excavation teeth on a trenching machine. The assembly includes a nose piece carried by the bucket of the earth excavation equipment, a digging point which fits about and is carried by the nose piece and a compressible locking assembly having a steel projecting portion. The locking assembly is disposed in a chamber in the lower surface of the nose piece with the projecting portion extending therefrom and into an aperture extending through the lower surface of the point and communicating with the chamber in the nose piece. To remove the point from the nose piece, a tool is provided which engages the point and the projecting portion of the locking assembly such that upon forcing the tool against the projecting portion of the locking assembly, the locking assembly is compressed and the projecting portion thereof is urged downwardly in the chamber while the point is driven forwardly thereover and off the nose piece.

11 Claims, 4 Drawing Figures

LOCKING MECHANISM FOR EARTH EXCAVATION TEETH

BACKGROUND OF THE INVENTION

The present invention relates to a locking mechanism for releasably securing earth excavation teeth or points on a trenching machine. It is well-known to provide earth excavation equipment such as trenching machines with points that can be removed for replacement when they become worn or damaged. Such points are generally mounted on a large tapered nose piece which in turn are mounted on the bucket of a large rotating wheel on the trenching machine. These points are typically secured to the nose piece by one or more pins which extend through aligned channels in the point and nose piece. Historically, horizontally disposed pins were used for such purposes. However, when the teeth on such equipment became more closely spaced, it became difficult to insert and remove horizontal pins from adjacent teeth. Flex pin arrangements which extended vertically through the point and nose piece were then developed as a substitute for the horizontal pins. Examples of vertical flex pin assemblies are found in U.S. Pat. No. 4,231,173 and in applicant's copending application Ser. No. 501,520 filed June 6, 1983, now U.S. Pat. No. 4,516,340.

While the vertical flex pin attachments had several advantages over the old horizontal pins, they did not solve all of the problems inherent in the securement of points onto trenching machines. If a flex pin, whether it be adapted for horizontal or vertical disposition is mishandled and dropped during installation or removal, they fall into the trench, delaying the replacement operation. This is an all too frequent occurrence due to the difficulty in aligning and handling the nose piece, point and pin or pins. Secondly, the use of locking pins requires a precise fit between the pin, the nose and the point, and the upper surfaces of the point through which vertical pins are inserted are constantly covered with dirt during the trenching operation. Should dirt become lodged in the cooperating channels in the pin or nose piece, proper alignment of the locking pins becomes difficult. Improper alignment often results in breakage. Further, because the points on trenching machines are mounted on buckets secured to a large rotatable wheel, the upper surface of the tooth is generally inaccessible for as soon as the wheel moves the tooth to an accessible elevated position, the tooth becomes inverted on the wheel with the upper side thereof facing the ground. This orientation makes a vertical pin replacement a relatively awkward and time-consuming operation.

It would therefore be highly desirable to provide a locking mechanism for large teeth on trenching equipment which retains the advantages of the vertically disposed flex locking pins, but which obviates their handling difficulties and which removes the mechanism from the upper surface of the point which is both inaccessible on such equipment and in constant contact with the dirt during the trenching operation.

SUMMARY OF THE INVENTION

The present invention relates to a locking mechanism for releasably securing excavation teeth or points on trenching machines. The assembly includes a nose piece adapted to be secured to the bucket of a trenching machine, a digging point which mates with and fits about the extended portion of the nose piece and a compressible stop assembly which is disposed in a chamber in the lower surface of the nose piece and projects therefrom into an aperture in the lower surface of the digging point.

In one embodiment of the invention, a resilient washer having a heat-treated steel core is disposed within the recess in the lower surface of the nose piece and a steel sphere is positioned on said washer and projecting from the recess in the nose piece into the aligned aperture extending through the lower surface of the point. The radius of the sphere is greater than the radius of the aperture in the point so that the sphere is held between the nose piece and the point, preventing the point from being pulled from the nose piece.

In a second embodiment, a spring mounted pin encased in a protective rubber sleeve is disposed within the chamber of the nose piece such that the enlarged steel head portion protrudes into the aperture in the digging point. To remove the point from the nose piece, a tool is provided which engages the base of the point and either the sphere or head portion of the pin such that upon striking the tool with a mallet, either the sphere is urged axially into the recess in the nose piece, temporarily deforming the washer therein while the nose piece is driven forwardly over the sphere and off the nose piece or the pin is urged downwardly compressing the spring while the nose piece is driven thereover.

It is the principal object of the present invention to provide an improved locking mechanism for releasably securing large excavation teeth on trenching machines.

It is another object of the present invention to provide a locking mechanism for releasably securing large earth excavation teeth on trenching machines which reduces the chance of a portion of the locking mechanism falling from the trenching machine during the mounting and demounting of teeth thereon.

It is a further object of the present invention to provide a locking mechanism for releasably securing large earth excavation teeth on trenching machines which is more accessible for the mounting and demounting of teeth thereon than the mechanisms heretofore available.

It is still a further object of the present invention to provide a locking mechanism for releasably securing large earth excavation teeth on trenching machines which substantially removes the mechanism from direct high pressure contact with the material being excavated during the trenching operation.

It is still a further object of the present invention to provide a locking mechanism for releasably securing large earth excavation teeth on trenching machines which is of simple construction and economical to manufacture.

It is yet another object of the present invention to provide a locking mechanism for releasably securing large excavation teeth on trenching machines which allows the tooth to be readily removed from the machine, rotated 180° and readily resecured so that both sides of the tooth can be utilized for trenching to prolong the useful life of the tooth.

These and other objects and advantages of the present invention will become apparent from the following detailed description taken in conjunction with the accompanying drawings.

IN THE DRAWINGS

DESCRIPTION OF THE PREFERRED EMBODIMENT

Figure 1:
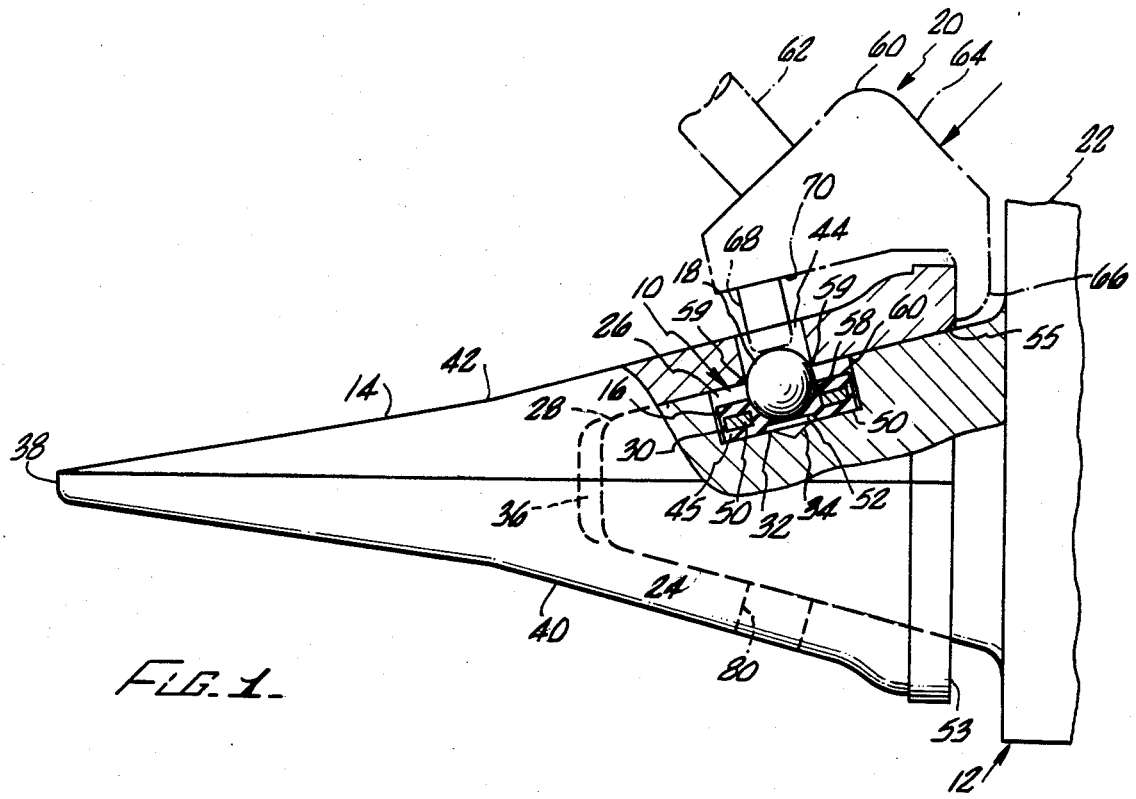
FIG. 1 is a partial sectional side view of the locking mechanism of the present invention shown in the inverted mounting position and including the releasing tool in place thereon.
Figure 2:
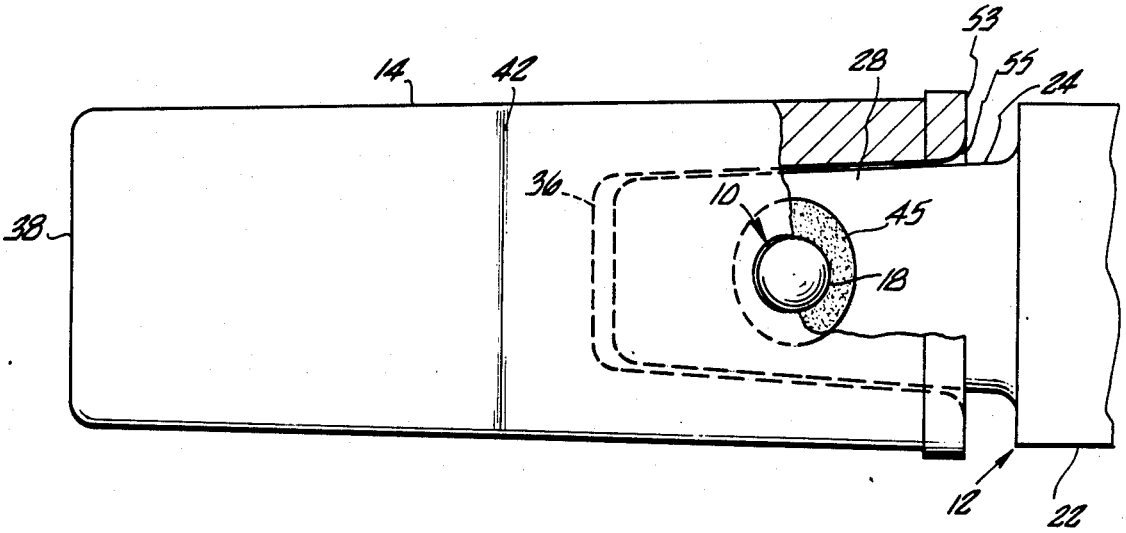
FIG. 2 is a bottom view of the locking mechanism of the present invention.

Referring now in detail to the drawings, one embodiment of the present invention is seen in FIGS. 1 and 2. These figures illustrate the present invention in the inverted position in which point 14 is affixed and secured to the nose piece 12 by the locking mechanism 10. Accordingly, what appears to be an upper surface in the drawing is actually the lower surface in the operative digging position. Reference herein to the components of the invention will be made to their relative positioning in the operative position.

As shown FIGS. 1 and 2, the locking mechanism 10 comprises a nose piece 12, a tooth or point 14, washer 16, locking sphere 18 and a release tool 20. The nose piece 12 is of forged steel construction and has a conventional base portion 22 which is adapted for conventional securement by a wedge locking mechanism to the dipper bucket on the wheel of a trenching machine [not shown]. Integrally formed with an extending forwardly of the base portion is a tapered extension 24 which carries the point 14. A chamber 26 opened at its lower end is formed in the under side 28 of the tapered extension 24. Chamber 26 is defined by a cylindrical vertical side wall 30 and bottom wall 32. The bottom wall 32 of the chamber 26 has a centrally disposed detent 34 therein.

The point 14 is also of forged steel construction and defines a cavity 36 in the rear portion thereof corresponding in configuration to the tapered extension 24 of the nose piece 12 so that the point 14 can fit snugly thereover in a mating relationship. Point 14 also defines a forward digging edge 38 and upper and lower tapered surfaces 40 and 42. Lower surface 42 has an aperture 44 extending therethrough which communicates with and is in axial alignment with the chamber 26 in the under side 28 of the nose piece 12. For reasons which will become apparent, aperture 44 is smaller in diameter than chamber 26.

The washer 16 is constructed of a vulcanized rubber sealing material 45 formed about a heat-treated steel resilient core or annulus 50 and is disposed in chamber 26 against bottom wall 32 therein. The washer 16 is slightly smaller in diameter than chamber 26 so that the chamber can accommodate compression and expansion of the washer during deformation thereof. Washer 16 also defines a centrally disposed recessed area 52 in the lower surface 54 thereof contoured to receive the steel locking sphere 18 and a centrally disposed recessed area 58 in the upper surface 60 thereof above sphere 18. The diameter of sphere 18 is larger than the diameter of the aperture 44 in point 14 so that the sphere cannot pass therethrough.

It is to be understood that the reference to the upper and lower surfaces on the various parts herein is with respect to the ground when the point 12 projects forwardly from the lower portion of the wheel on the trenching machine for digging. When the point 14 is to be mounted or removed from the nose piece 12, the wheel on the trenching machine [not shown]is rotated so that the nose piece 12 and point 14 are elevated at the top of the wheel whereupon, due to the rotation of the wheel, the nose piece 12 and point 14 would be inverted so that the under sides 28 and 54 of the nose piece and point would then define their upper surfaces and be readily accessible. To avoid any confusion, however, these surfaces 28 and 54 will be continuously referred to herein as lower surfaces reflecting their disposition with respect to the ground in the digging mode.

To secure the point 14 to the nose piece, the nose piece is first brought to the inverted position, exposing chamber 26. The washer 16 is disposed therein on bottom wall 32, the locking sphere 18 is placed thereon and the point 14 is then driven rearwardly toward the base portion 22 of the nose piece. The base portion 53 of point 14 has a rounded interior edge surface 55 so that when surface 55 abuts the locking sphere 18 as the point is driven rearwardly, the locking sphere is forced downwardly within chamber 26 in the nose piece, deforming washer 16 and allowing the base portion 53 of the point 14 to pass thereover. As soon as the base portion 53 of the point 14 clears the locking sphere 18 such that the aperture 44 in the point is axially aligned with chamber 26 in the nose piece, the memory or resilience in the annulus 50 of washer 16 causes the washer to push the upper portion of the locking sphere 18 into the aperture 44 in the nose piece 14. Because of the relative size of the sphere 18 and aperture 44, the sphere, with the washer returned to its original undeformed state, is held between the nose piece 12 and point 14 with the interior edge 59 of aperture 44 abutting the locking sphere 18 as seen in FIG. 1. So disposed, the locking sphere 18 prevents the point 14 from being withdrawn from the nose piece 12. It should be noted that the aperture 44 is formed by a drilling process in point 14 so as to provide the point with a sharp perpendicularly disposed edge 59 about aperture 44. This edge 59 causes the locking sphere 18 to merely roll within chamber 26 and aperture 44 upon the point 14 being urged forwardly on the nose piece 12 thereby preventing inadvertent removal of the point. If edge 15 were rounded, such a force would cause the point 14 to slide upwardly on the locking sphere 18, depressing washer 16 and allowing the point to be inadvertently detached from the nose piece in the same manner in which the rounded edge 55 on the base portion 53 of the point depressed the locking sphere during installation.

To remove the point 12 from the nose piece 14, the release tool 20 is employed. Tool 20 comprises a body 60, an elongated handle 62 extending from the forward portion of body 60, a striking surface 64 disposed on the rearward portion of the body 60 and angularly disposed at about 45° with respect to a vertical axis passing therethrough. The tool also defines a rearwardly disposed vertical point abutment flange 66 and a sphere abutment rod 68. Rod 68 extends perpendicularly from the under side 70 of the forward portion of body 60 which in turn is inclined with respect to the vertical at an angle corresponding to the angle of taper of the lower surface 42 of point 12 with respect to the horizontal. Accordingly, when the tool 20 is held in place by handle 62, the point abutment flange 66 of the tool abuts the base 53 of the point 14 along a vertical line of contact and the sphere abutment rod 68 abuts the locking sphere 18 such that the central axis of rod 68 is coincident with the central axis of aperture 44 in point 14. Upon striking the inclined striking surface 64 of tool 20 with a suitable mallet, the forces generated concurrently urge the point 14 forwardly of the nose piece 12 through flange 66 bearing against the base 53 of the nose piece while the locking sphere 18 is driven downwardly by the projecting rod 68 into chamber 26 in the nose piece, allowing the sharp edge 59 on the point 14 which generally abuts the locking sphere 18 to pass thereover. While the washer 16 is temporarily deformed by locking sphere 18, the point 14 can pass off the nose piece 12 whereupon the washer 16 returns the locking sphere to its normal extended position protruding from chamber 28. As the nose piece 12 and point 14 are inverted on the trenching machine during this operation, the locking sphere 18 is retained by gravity within chamber 26 in the nose piece.

In order to enable one to reverse the orientation of the point 14 on the nose piece when the forward digging portion of the upper tapered surface 40 thereon becomes worn, a second aperture 80 could be provided in the upper surface 40 of the point which is identical in configuration to aperture 44. Accordingly, when one surface of the point becomes worn, the point can be rotated 180° and aperture 80 used to secure the tooth in place on the nose piece in the same manner as aperture 44. Further, if desired, the washer 46 and locking sphere 18 could be vulcanized together to form a single element as opposed to two separate elements.

Figure 3:
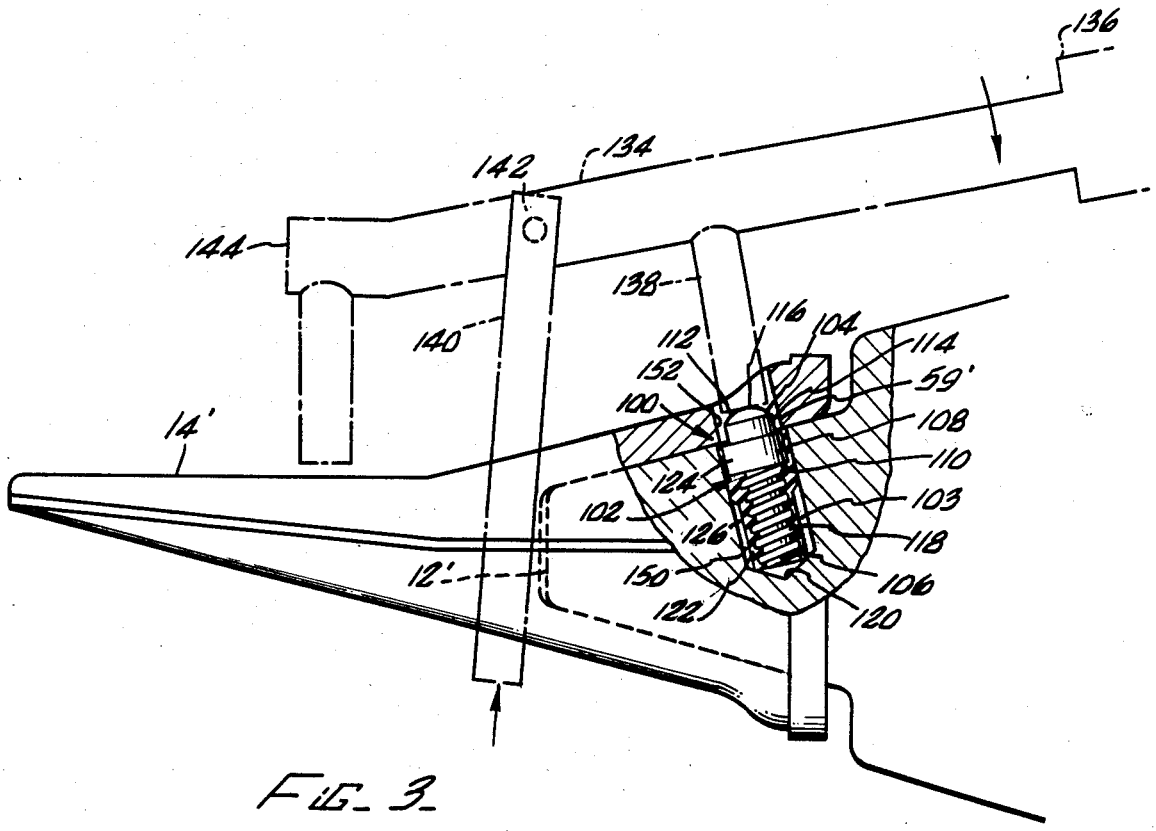
FIG. 3 is a partial sectional side view of a second embodiment of the present invention shown in the inverted mounting position and including a second embodiment of the releasing tool in place thereon.
Figure 4:
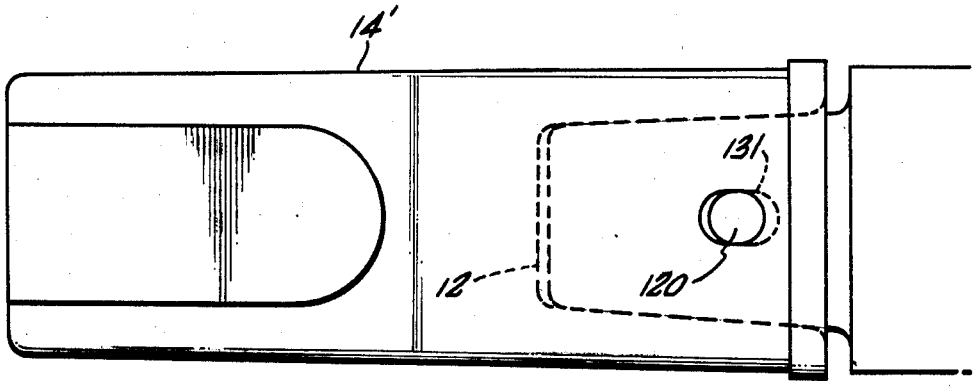
FIG. 4 is a bottom view of the second embodiment of the locking mechanism of the present invention.

A second embodiment of the invention, also shown in the inverted mounting and demounting position, is illustrated in FIGS. 3 and 4 wherein a locking pin assembly 100 is employed in lieu of the washer 16 and locking sphere 18 of the prior embodiment to define the compressible stop assembly for securing the tooth or point onto the nose piece. The pin assembly 100 like washer 16 and locking sphere 18 is disposed within a chamber 103 in the under side 28' of the tapered extension 24' of the nose piece 12'. Chamber 103 in nose piece 12' differs from chamber 26 in nose piece 12 of the prior embodiment in that chamber 103 is deeper and smaller in diameter than chamber 26.

The locking pin assembly 100 is comprised of an integrally formed steel pin 102 having a head portion 104 and leg portion 106. The head portion 104 defines an enlarged cylindrical base 108, shoulder 110 and a projecting upper portion 112 having a vertical cylindrical wall 114 and curved upper surface 116. A coil spring 118 is disposed about the leg portion 106 of pin 102, abutting shoulder 110 at one end thereof and the bottom wall 120 of chamber 103 at the other end. A cylindrical resilient casing 122 preferably constructed of rubber or other polymer material is molded about pin 102 and spring 118 defining an upper enlarged constant diameter portion 124 and a lower constant outer diameter portion 126. The upper enlarged portion of casing 122 is disposed about the head portion 104 of the pin and extends therefrom over a portion of the leg portion of the pin and a portion of the coil spring as seen in FIG. 3. The lower portion 126 of casing 122 extends about the remainder of the coil spring 118. The upper constant diameter portion 124 is sized to the approximate diameter of the cylindrical chamber 103 so as to define a tight press fit when the pin assembly 100 is disposed within chamber 103 as seen in FIG. 3. The rubber casing 122 thus acts to keep foreign matter out of chamber 103 and away from the coil spring 118 so as to insure proper fitment and operation.

The diameter of the enlarged base 108 of the head portion of the pin is larger than the transverse dimension of the elliptically-shaped aperture 131 in the point 14' so that when the point 14' is in place on the nose pin 12', the projecting upper portion 112 of the pin 102 projects into aperture 131 but the enlarged base of the head portion of the pin prevents the pin from passing therethrough and inadvertently allowing the point to be removed from the nose piece. The vertical cylindrical side wall 114 of the projecting upper portion 112 of pin 102 provides a stop against which the cylindrical wall defining chamber 103 in the point abuts to retain the point on the nose piece.

The release tool 132 employed with the second embodiment of the invention comprises of elongate bar 134 having a handle 136 at one end thereof, a first pressing rod 138 intermediary of the ends thereof and extending perpendicularly with respect to the longitudinal axis of bar 134 and a U-shaped point abutment support bracket 140 pivotally mounted on the bar 134 at 142 between pressing rod 138 and the extended end 144 of the bar 134.

In use, the release tool 132 is positioned as illustrated in FIG. 3 such that the support bracket 140 is disposed below and against the point 14' and the first pressing rod 138 abuts the upper curved surface 120 of the head portion 110 of pin 102. Pushing downwardly on the handle (as seen in FIG. 3) forces the pin 102 into chamber 103 compressing the coil spring 118. The smaller constant diameter portion 126 of rubber sleeve of casing 122 provides for an annular space 150 between casing 122 and the cylindrical wall of channel 103 such that upon compression of the coil spring the casing can move outwardly into the annular spacing 150. As the pin assembly 100 is compressed by the release tool, the point 14' can be manually pulled from the nose piece 12' as the edge 59' on point 12' is free to slide over the depressed pin 102. Prior to depressing pin 102 within chamber 103, the vertical side wall 114 of the head portion 104 of pin 102 abuts edge 59' and the rearward portion of the vertical side wall 152 of aperture 131 in point 14' which prevents the point from being inadvertently removed from the nose piece.

By way of example, on a given tooth a coil spring having a spring rate of 34 lbs. has been successfully employed in this embodiment of the invention. A spring rate of 22.5 lbs. has also been employed but with the rubber casing 122 having a Shore Hardness of 70. This lower spring rate and stiffer casing provides the pin assembly 100 with comparable compression characteristics to the stiffer spring while being more economical to manufacture. On different size teeth, different spring rates and casing hardnesses would be employed. The spring rate and hardness of the casing should be of sufficient compressibility and strength to remain in position to lock the tooth in place continuously under digging conditions of stress, vibration and contact with the material being dug.

Various other changes and modifications could be made in carrying out the present invention without departing from the spirit and scope thereof. Insofar as these changes and modifications are within the purview of the appended claims, they are to be considered as part of the present invention.

I claim:

1. A locking assembly for releasably securing earth excavation points on the bucket of a trenching machine, said assembly comprising:

a nose piece adapted to be secured to the bucket of a trenching machine and defining an extension having tapered side walls, converging upper and lower surfaces and an open cylindrical chamber recessed in said extension, the central axis of said chamber being perpendicular with respect to the lower surface of said extension;

an excavation point defining converging upper and lower surfaces, a digging edge at the forward end thereof and a cavity at the rearward end thereof, said cavity being adapted to receive said extension of said nose piece and defining upper and lower converging wall portions adapted to abut and mate with said upper and lower converging surfaces on said extension of said nose piece, said lower wall portion having an aperture extending perpendicularly therethrough and communicating with said cavity, said aperture defining a radius less than the radius of said chamber in said nose piece, and upon said cavity receiving said extension, said aperture communicates with said chamber in said nose piece; and a locking means disposed within said chamber, said means comprising a resilient deformable biasing member disposed within said chamber, said member being encased in a flexible sealing material, and a locking member carried by said resilient biasing member extending from said chamber into said aperture in said point and abutting said point about the perimeter of said aperture to retain said point on said nose piece, at least a portion of said locking member defining a transverse dimension greater than the radius of said aperture.

2. The combination of claim 1 including a tool for releasing said point from said nose piece comprising a body portion, a handle means carried by said body portion, a point abutment member for securing said tool against said point, and a locking means abutment member extending downwardly from said body portion and angularly disposed with respect thereto such that upon disposing said point abutment member against said point and said locking means abutment member in abutment with said locking member, the central axis of said locking means abutment member is coincident with the central axes of said locking member and said open chamber in said nose piece whereby upon urging said locking means abutment member against said locking member, said locking means is forced downwardly within said chamber in said nose piece deforming said resilient biasing member and allowing said point to pass thereover and off said nose piece.

3. A locking assembly for releasably securing earth excavation points on the bucket of a trenching machine, said assembly comprising:

a nose piece adapted to be secured to the bucket of a trenching machine and defining an extension having tapered side walls, converging upper and lower surfaces and an open chamber recessed in said extension from said lower surface;

an excavation point defining converging upper and lower surfaces, a digging edge at the forward end thereof and a cavity at the rearward end thereof, said cavity receiving said extension of said nose piece and defining upper and lower converging wall portions adapted to abut and mate with said upper and lower converging surfaces on said extension of said nose piece, said lower wall portion having a cylindrical aperture extending perpendicularly therethrough and communicating with said cavity and upon said cavity receiving said extension, said aperture communicates with said chamber in said nose piece;

a resilient deformable biasing member disposed within said chamber in said nose piece, said member being encased in a flexible sealing material; and a locking sphere having a diameter less than the diameter of said cylindrical aperture in said point and disposed axially over said member on said sealing material in said chamber in said nose piece and project therefrom into said cylindrical aperture in said point and abut said point about the perimeter of said cylindrical aperture therein whereby said point is retained on said nose piece.

4. The combination of claim 3 including a tool for releasing said point from said nose piece comprising a body portion, an inclined striking surface defined by said body portion, handle means carried by said body portion, a vertically disposed point abutment member extending below said striking surface and adapted to abut the rearward end of said point and a sphere abutment member extending downwardly from said body portion forwardly of said point abutment member and angularly disposed with respect thereto such that upon said point abutment member abutting the rearward end of said point said sphere abutment member abuts said sphere such that the central axis of said sphere abutment member is coincident with the central axis of said cylindrical aperture in said point whereby upon striking said inclined striking surface said point is driven from said nose piece by said point abutment member as said sphere is forced downwardly within said chamber in said nose piece temporarily deforming said resilient biasing member therein and allowing said point to pass thereover and off said nose piece.

5. The combination of claims 3 or 4 wherein said resilient deformable biasing member is comprised of a heat-treated steel annular core and said sealing material encases said annular core and defines a centrally disposed recessed seat therein for said sphere interiorly of said core.

6. The combination of claim 4 wherein said striking surface is angularly disposed at about 45° with respect to said vertically disposed point abutment member.

7. A locking assembly for releasably securing earth excavation points on the bucket of a trenching machine, said assembly comprising:

a nose piece adapted to be secured to the bucket of a trenching machine and defining an extension having tapered side walls, converging upper and lower surfaces and an open cylindrical chamber recessed in said extension from said lower surface;

an excavation point defining upper and lower surfaces converging forwardly toward a central horizontal axis passing through said point, a digging edge at the forward end thereof and a cavity in the rearward end thereof, said cavity snugly receiving said extension and defining upper and lower converging wall portions adapted to abut and mate with said upper and lower converging surfaces on said extension of said nose piece, said lower wall portion having a cylindrical aperture extending perpendicularly therethrough communicating with said cavity and upon said cavity snugly receiving said extension, said aperture communicates with said chamber in said nose piece, the diameter of said cylindrical aperture being less than the diameter of said cylindrical chamber;

an annular member disposed in said chamber in said nose piece, said member being comprised of a deformable resilient sealing material disposed about a heat-treated steel annular core rectangular in cross section, said member defining a recessed seat interiorly of said core;

a locking sphere disposed on said seat in said annular member and sized such that upon said extension of said point being snugly disposed on said extension of said nose piece, said sphere projects from said chamber in said nose piece into said cylindrical aperture in said point and abuts said point about the perimeter of said cylindrical aperture whereby said point is securely retained on said nose piece; and a tool to concurrently engage said point and said sphere for releasing said point from said nose piece, said tool comprising a body portion, an inclined striking surface defined by said body portion, a depending point abutment member adapted to abut the rearward end of said point and a depending sphere abutment member angularly disposed with respect to said point abutment member such that upon said point abutment member abutting the rearward end of said point, said sphere abutment member abuts said sphere such that the central axis of said sphere abutment member is coincident with the central axis of said cylindrical aperture in said point and said striking surface is disposed at an angle of about 45° with respect to the central horizontal axis passing through said point, whereby upon striking said striking surface said point is driven from said nose piece by said point abutment member as said sphere is forced downwardly within said chamber in said nose piece temporarily deforming said annular member therein and allowing said point to pass thereover off said nose piece.

8. The combination of claim 7 wherein said tool includes a handle extending from said body portion for positioning said point abutment member and said sphere abutment member with respect to said point and said sphere.

9. A locking assembly for releasably securing earth excavation points on the bucket of a trenching machine, said assembly comprising:

a nose piece adapted to be secured to the bucket of a trenching machine and defining an extension having tapered side walls, converging upper and lower surfaces, and an open cylindrical chamber recessed in said extension, the central axis of said chamber being perpendicular with respect to said lower surface of said extension;

an excavation point defining converging upper and lower surfaces, a digging edge at the forward end thereof and a cavity at the rearward end thereof, said cavity being adapted to receive said extension of said nose piece and defining upper and lower converging wall portions adapted to abut and mate with said upper and lower converging surfaces on said extension of said nose piece, said lower wall portion having a cylindrical aperture extending perpendicularly therethrough and communicating with said cavity and upon said cavity receiving said extension, said aperture communicates with said chamber in said nose piece; and a compressible locking assembly including a solid rigid pin member defining an enlarged head portion and a leg portion, a coil spring disposed about said leg portion and extending from said head portion beyond said leg portion and a flexible casing extending about said spring and a portion of said head portion, sealing said spring and securing said spring in place about said leg portion, said locking assembly being disposed within said cylindrical chamber in said nose piece such that a portion of said head portion projects from said chamber into said aperture in said point for securing said point on said nose piece and upon urging said pin member downwardly within said chamber against said coil spring, said point can be removed from said nose piece.

10. The combination of claim 9 wherein said casing is of integral construction and defines a first constant radius portion and a second constant radius portion, said first constant radius portion having a diameter substantially equal to the diameter of said cylindrical chamber for securing said pin assembly within chamber and greater than said second constant radius portion so as to define an annular chamber about said second constant radius portion upon disposing said locking assembly within said cylindrical aperture for accommodating the flexing of said casing upon compressing said spring during removal of said point from said nose piece.

11. The combination of claim 10 including a tool for releasing said point from said nose piece comprising a body portion, a handle means carried by said body portion, a point abutment member for securing said tool against said point, and a locking means abutment member extending downwardly from said body portion and angularly disposed with respect thereto such that upon disposing said point abutment member against said point and said locking means abutment member in abutment with said head portion of said pin member, the central axis of said locking means abutment member is coincident with the central longitudinal axes of said pin member and said open chamber in said nose piece whereby upon urging said locking means abutment member axially against said head portion of said pin member, said pin member is forced downwardly within said chamber in said nose piece allowing said point to pass over said head portion and off said nose piece.

* * * * *